US006698027B2

(12) United States Patent
Park

(10) Patent No.: US 6,698,027 B2
(45) Date of Patent: Mar. 2, 2004

(54) GOLF GLOVES

(76) Inventor: Jung Ho Park, San #1, Woonyang-dong Kimpo-shi, Kyunggi-do, 415-050 (KR)

( * ) Notice: Subject to any disclaimer, the term of this patent is extended or adjusted under 35 U.S.C. 154(b) by 0 days.

(21) Appl. No.: 10/421,117

(22) Filed: Apr. 23, 2003

(65) Prior Publication Data

US 2003/0208834 A1 Nov. 13, 2003

(30) Foreign Application Priority Data

May 13, 2002 (KR) ..... 2002-0014542

(51) Int. Cl.[7] ..... A41D 19/00
(52) U.S. Cl. ..... 2/161.2
(58) Field of Search ..... 2/16, 20, 159, 2/160, 161.3, 161.1, 161.2, 161.6, 163; 473/205

(56) References Cited

U.S. PATENT DOCUMENTS 5,542,126 A * 8/1996 Harvanek ..... 2/161.2
5,704,065 A * 1/1998 Feuerhake ..... 2/161.2
6,195,804 B1 * 3/2001 Fraser ..... 2/161.2
6,363,535 B1 * 4/2002 Landis ..... 2/161.4
6,513,166 B1 * 2/2003 Landis ..... 2/161.4

* cited by examiner

*Primary Examiner*—Gary L. Welch
(74) *Attorney, Agent, or Firm*—Ladas & Parry

(57) ABSTRACT

A left golf glove includes a left pressure part formed on a selected portion of at least one of the middle finger, the ring finger, and the pinky finger; a left holding part formed on a selected portion of the palm part; a first left indication part formed on a selected portion of the thumb; and a second left indication part formed on a selected portion of the palm opposite part. A right golf glove includes a right pressure part formed on a selected portion of at least one of the middle finger and the ring finger; a right holding part formed on a selected portion of the palm part; a right indication part formed on a selected portion of the thumb; and a second right holding part also formed on a selected portion of the thumb. The left golf glove and the right golf glove provide control over a golf club and also provide indication of a proper grip.

5 Claims, 8 Drawing Sheets

GOLF GLOVES

BACKGROUND OF THE INVENTION

1. Field of the Invention

This invention relates generally to golf gloves, and more particularly to golf gloves that allow a user of the golf gloves to more accurately grip or place the user's hands on the golf club shaft for consistently accurate hitting of a golf ball.

2. Description of the Prior Art

Generally in playing golf, the manner of holding a shaft of a golf club such as a driver or an iron is known as a grip. The grip acts as a joint that connects the body of a golf player to the golf club and allows the golf player to hit the golf ball with the club face of the golf club so as to transit the golf ball in the intended field direction. When gripping a golf club shaft, generally the middle portion of the index finger (i.e., the section between the first and the second index finger joints from the top) is placed to the golf club shaft, and the golf club shaft is controlled by the middle finger, and the ring finger, and the pinky finger of the left hand that is holding the shaft. For the right hand, the middle finger and the pinky finger acts mainly as the central points for holding the shaft.

However, the conventional golf gloves place the emphasis mainly on the function of preventing the golf club shaft from slipping out of the gripping hands. Because of this fact that the conventional golf gloves provide only the functions of tight placement between the golf gloves of gripping hands and the golf club shaft, novice golf players using the conventional golf gloves are unable to easily, accurately, and consistently grip the shaft in a correct manner.

As an attempt to solve the above-mentioned problem, another type of conventional golf gloves have been disclosed in the Korean Patent REG. NO. 1663795, one of which golf glove is shown in FIG. 1. As shown in FIG. 1, this conventional left hand golf glove 10 has a palm part 11, a thumb 12, and a index finger 13. Additionally, this conventional hand golf glove 10 has an indication part 20 running diagonally on the palm part 11 between near the bottom finger joint of the index finger 13 and the lower portion of the palm part 11 near the pinky finger.

This conventional golf glove as shown in FIG. 1 may allow a golf player to maintain a certain direction between the gripping hand and the shaft. However, the pressure is required to be applied by the fingers that are gripping the shaft that makes difficult to accurately hit a golf ball, and further the indication part 20 is hidden from view after gripping the shaft, which renders the golf player impossible to correct his gripping position of his hands even after he has imprecisely gripped the shaft.

Accordingly, there is a need for golf gloves that allow the golf player to more accurately and precisely hold his golf club, and furthermore there is a need for golf gloves that allows the golf player be aware of the correctness of his grip and to correct his grip, if inaccurate.

SUMMARY OF THE INVENTION

Against this backdrop, the present invention has been developed. Each in a pair of golf gloves has a palm part, a palm opposite part, a thumb, an index finger, a middle finger, a ring finger, and a pinky finger. The golf gloves comprises a left golf glove and a right golf glove, The left golf glove includes a left pressure part formed on a selected portion of at least one of the middle finger, ring finger, and the pinky finger; a left holding part formed on a selected portion of the palm part; a first left indication part formed on a selected portion of the thumb; and a second left indication part formed on a selected portion of the palm opposite part.

The right golf glove includes a right pressure part formed on a selected portion of at least one of the middle finger and the ring finger; a right holding part formed on a selected portion of the palm part; a right indication part formed on a selected portion of the thumb; and a second right holding part also formed on a selected portion of the thumb.

The left hand glove and the right hand glove provide control over a golf club to a user of the gloves and also provide indication to the user of a proper grip of the golf club, and allow a subsequent modification of the grip.

The first left indication part of the left hand glove and the right indication part of the right hand glove point toward the left shoulder of the user when the user has gripped the shaft of a golf club using the left and right gloves. Further, the second left indication part is formed on the selected portion of at least one of the index finger and the middle finger of the left golf glove and is visible to the user when the user has gripped the shaft of a golf club using the left and right gloves.

In the left golf glove, the left pressure part, the left holding part, the first left indication part, and the second left indication part are made from one or a combination of two or more of: a first secondary layer placed over the surface of the left hand glove; a second secondary layer placed under an exposed portion of the left hand glove; a hole exposing a portion of the left hand glove; a protruding part protruding on the surface of the left hand glove; and a color on the surface of the left hand glove.

Likewise in the right golf glove, the right pressure part, the right holding part, the right indication part, and the second right holding part are made from one or a combination of two or more of: a first secondary layer placed over the surface of the right hand glove; a second secondary layer placed under an exposed portion of the right hand glove; a hole exposing a portion of the right hand glove; a protruding part protruding on the surface of the right hand glove; and a color on the surface of the right hand glove.

These and various other features as well as advantages which characterize the present invention will be apparent from a reading of the following detailed description and a review of the associated drawings.

DETAILED DESCRIPTION

The golf gloves according to an embodiment of the present invention is designed to enable a user to more accurately and easily grip a golf club such as a driver or an iron. Furthermore, the golf gloves according to an embodiment of the present invention allows the user to correct his grip even after the initial gripping of the shaft and during the swing of the golf club.

Figure 1:
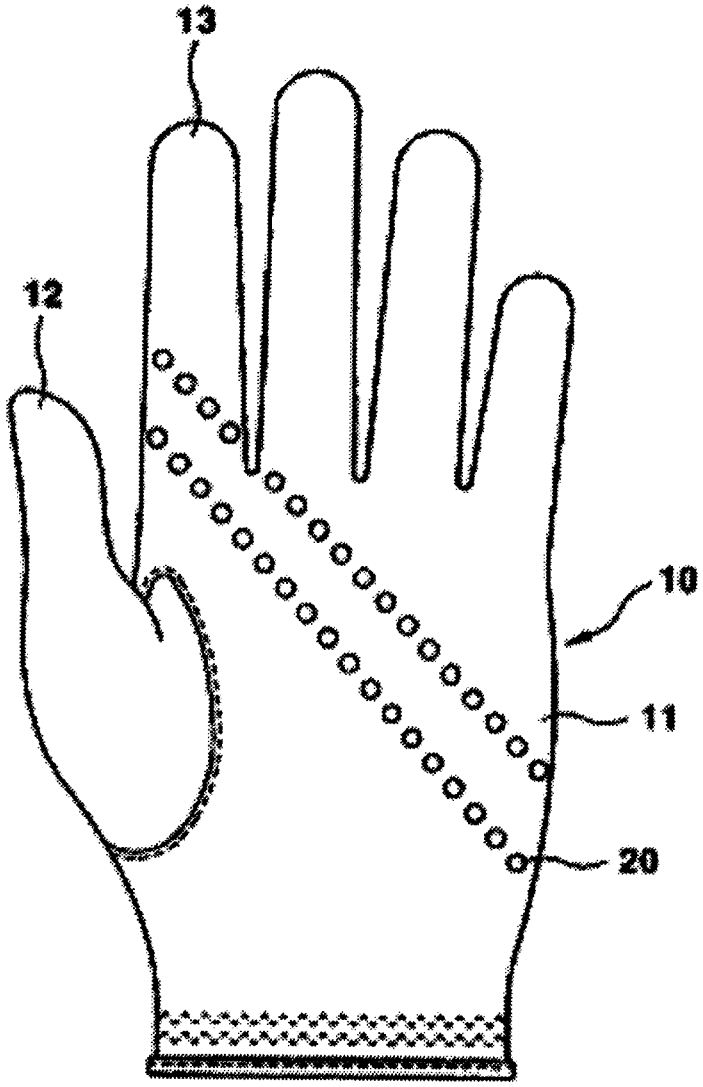
FIG. 1 (PRIOR ART)
FIG. 1 is a perspective view of a conventional golf glove.
Figure 2:
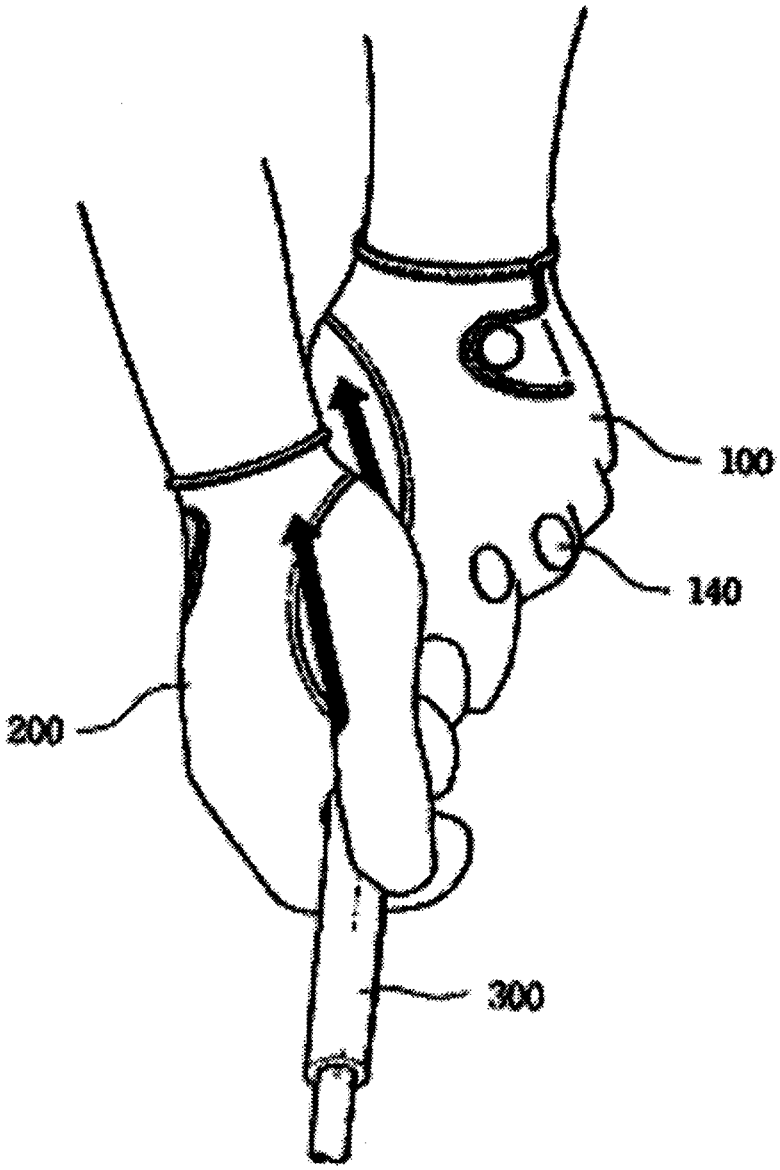
FIG. 2 is a perspective view showing hands wearing the golf gloves and holding the shaft of a golf club according to an embodiment of the present invention.

As shown in FIG. 2, the golf gloves according to an embodiment of the present invention is comprised of a left hand glove 100 and a right hand glove 200, cooperatively gripping a shaft 300 of a golf club.

Figure 3A:
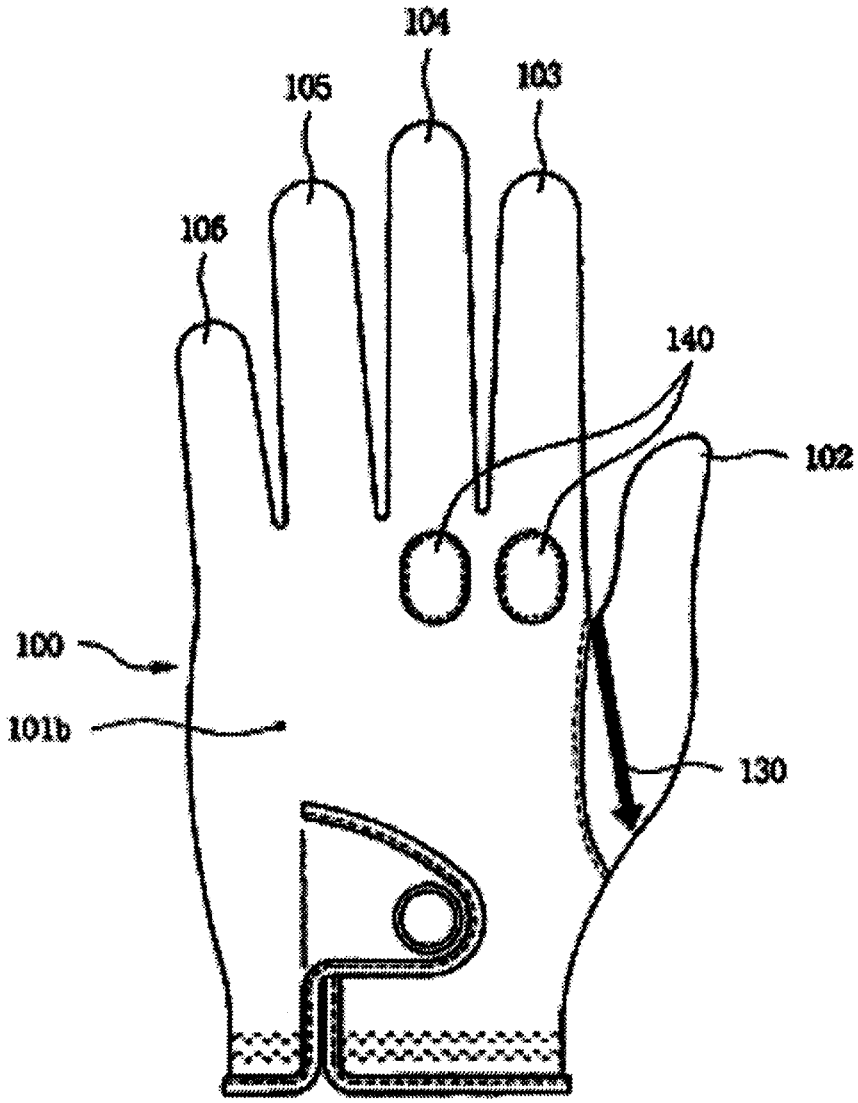
FIG. 3*a* is a front view of the left hand glove according to an embodiment of the present invention.
Figure 3B:
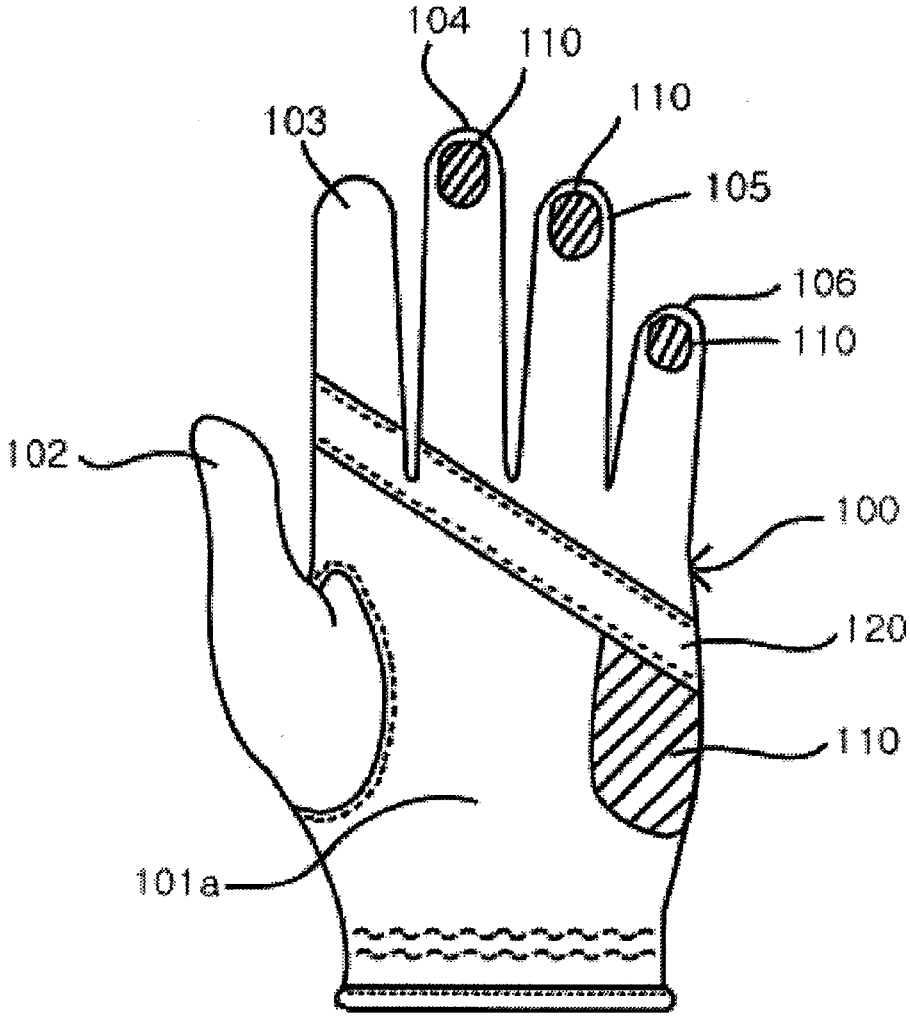
FIG. 3*b* is a rear view of the left hand glove according to an embodiment of the present invention.

Now referring to FIGS. 3*a*–3*b*, the left hand glove 100 has a left palm part 101*a*, a left palm opposite part 101*b*, a left thumb 102, a left index finger 103, a left middle finger 104, a left ring finger 105, and a left pinky finger 106. A left pressure part 110 is formed preferably at the tip of each of the left middle finger 104, the left ring finger 105, and the left pinky finger 106. In addition, a left holding part 120 is formed on the left palm part 101*a* linearly between the bottom portion of the left index finger 103 and the bottom portion of the left pinky finger 106 as shown in FIG. 3*b*. This placement of the left holding part 120 is generally known as the placement along the "life line" of a left hand according to the traditional art of Korean palm reading.

Further, as shown in FIG. 3*a*, a first left indication part 130 (near the bottom of the left thumb 102 joining the left palm opposite part 101*b*) and one or more of a second left indication part 140 (near the bottom of the left index and middle fingers 103, 104 joining the left palm part 101*a*) are formed on the left hand glove 100. Additionally a supportive holding part (not shown in figures) is formed in a shape of encircling a shaft 300 of a golf club at the end of the left holding part 120.

Now referring to FIGS. 5*a*–5*e*, the left pressure part 110, the left holding part 120, the first left indication part 130, and the second left indication 140 may be formed on the layer of the left palm part 101*a* or the left palm opposite part 101*b* (collectively also referred to as a "palm layer") by a secondary layer 120*a* (shown in FIG. 5*a*) placed over the palm layer, or by a secondary layer 120*a* (shown in FIG. 5*b*) placed under an exposed portion of the palm layer, or by a plurality of holes 120*b* (shown in FIG. 5*c*), or by a plurality of protruding parts 120*d* (shown in FIG. 5*d*) on the palm layer, or by a color 120*c* (shown in FIG. 5*e*) on the palm layer. The secondary layer 120*a* shown in FIGS. 5*a*–5*b* also provides better friction between the golf glove and the shaft. The holes 120*b* or the protruding parts 120*d* are generally formed at a regularly spaced interval. The color 120*c* may include one or more colors on the palm layer.

Now referring back to FIGS. 3*a*–3*b*, the first left indication part 130 is designed to provide a directional indication of the left hand glove 100 gripping the shaft 300. More specifically, when the golf player wearing the golf gloves 100, 200 has correctly gripped the shaft 300, the first left indication part 130 would align in the linear direction to point toward the golf player's left shoulder (along his line of sight) from the left side of the shaft 300. When this is achieved, the end of the shaft 300 would be placed near the crease of the left leg of his pants.

The second left indication part 140 is visibly formed on the left palm opposite part 101*b* (e.g., near the bottom of each left index and left middle finger 103, 104 joining the left palm opposite part 101*b*) allowing the golf player to observe the second left indication part 140 along his line of sight after gripping the shaft 300.

Figure 4A:
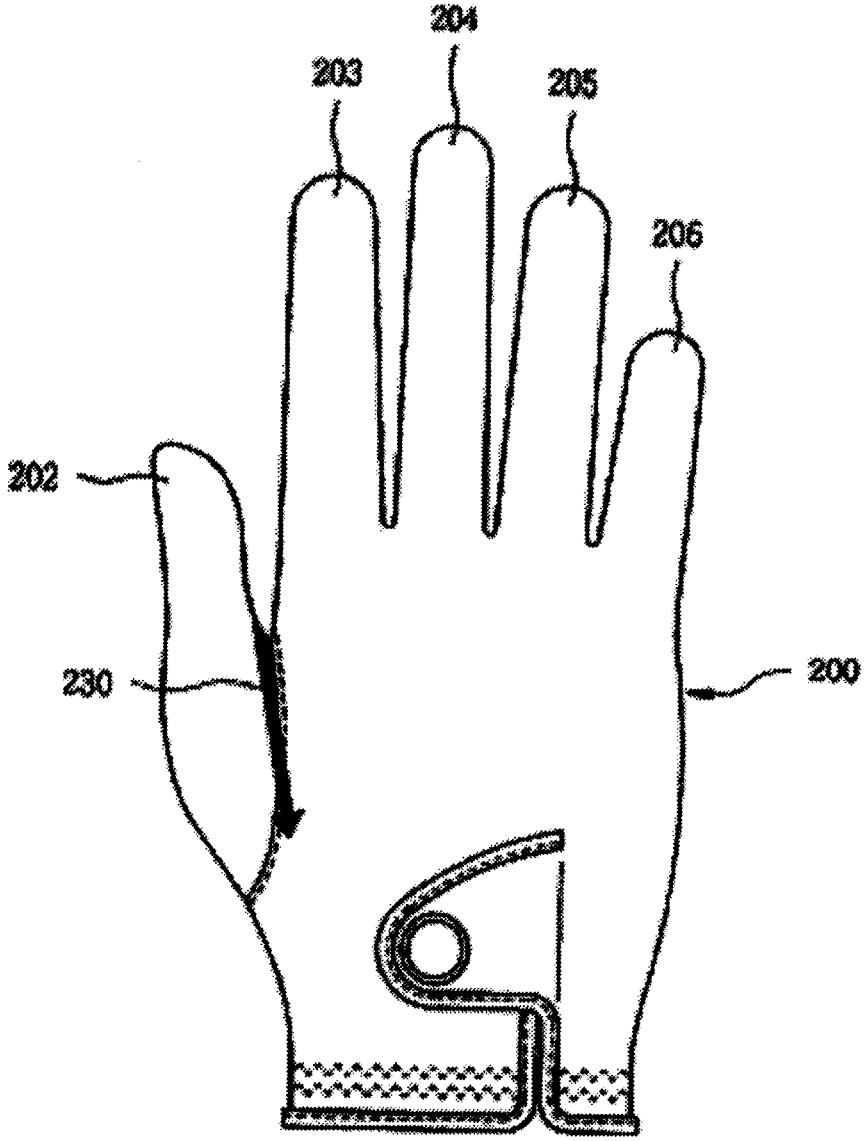
FIG. 4*a* is a front view of the right hand glove according to an embodiment of the present invention.
Figure 4B:
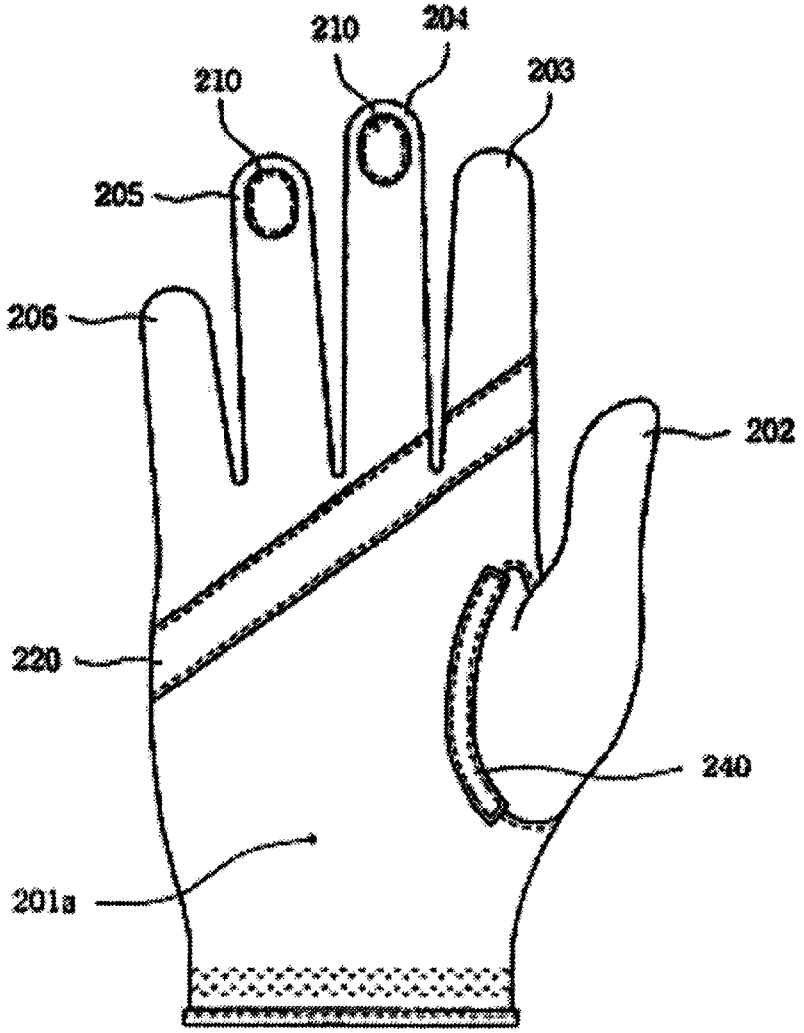
FIG. 4*b* is a rear view of the left hand glove according to an embodiment of the present invention.
Figure 5A:
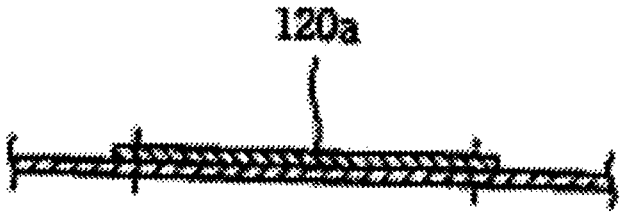
FIGS. 5*a*–5*e* are sectional views of a portion of the golf glove material according to an embodiment of the present invention.
Figure 5B:
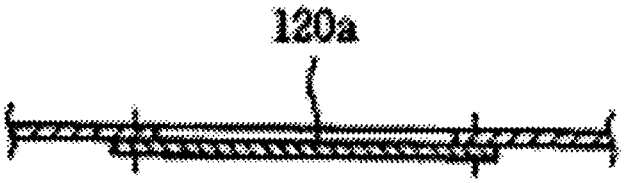
Figure 5C:
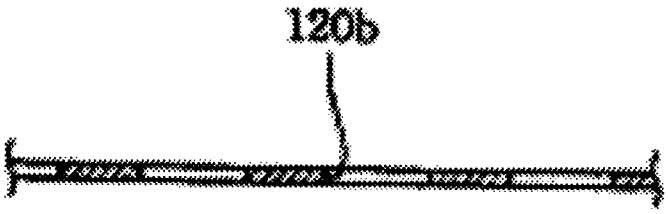
Figure 5D:
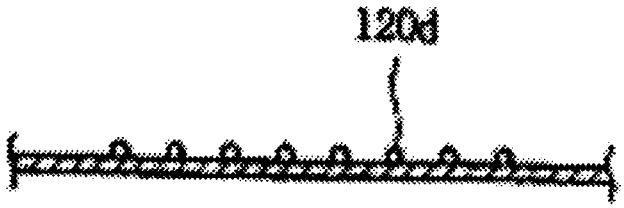
Figure 5E:
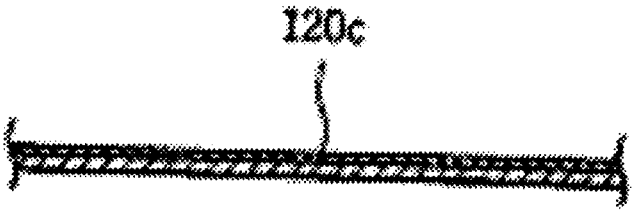

Now referring to FIGS. 4*a*–4*b*, a right hand glove 200 according to an embodiment of the present invention is symmetrically similar in shape to the left hand glove 100. The right hand glove 200 has a right palm part 201*a*, a right palm opposite part, a right thumb 202, a right index finger 203, a right middle finger 204, a right ring finger 205, and a right pinky finger 206. One or more of right pressure parts 210 are formed at the tip of each of the right middle finger 204 and the right ring finger 205. A right holding part 220 is placed on the right palm part 201*a* as linearly running between the bottom portion of the right index finger 203 and the bottom portion of the right pinky finger 206 as shown in FIG. 4*b*. In addition, a first right indication part 230 is formed on the right palm opposite part 201*b* at near the bottom of the right thumb 230 as shown in FIG. 4*a*. A second right holding part 240 is formed on the palm part 201*a* at near the bottom of the thumb 202 as shown in FIG. 4*b*.

As it was the case with the left hand glove 100 and now referring again to FIGS. 5*a*–5*e*, the right pressure part 210, the right holding part 220, the second right holding part 240, and the first right indication part 230 can be formed on the layer of the right palm part 201*a* or the right palm opposite part 201*b* (collectively also referred to as a "right palm layer") by a secondary layer 120*a* (shown in FIG. 5*a*) placed over the right palm layer, or by a secondary layer 120*a* (shown in FIG. 5*b*) placed under an exposed portion of the right palm layer, or by a plurality of holes 120*b* (shown in FIG. 5*c*) or a plurality of protruding parts 120*d* (shown in FIG. 5*d*) on the right palm layer, or by a color 120*c* (shown in FIG. 5*e*) on the right palm layer. The secondary layer 102*a* shown in FIGS. 5*a*–5*b* also provides better friction between the golf glove and the shaft. The holes 120*b* or the protruding parts 120*d* are generally formed at a regularly spaced interval. The color 102*c* may include one or more colors on the palm layer.

Now referring to FIGS. 4*a*–4*b*, the first right indication part 230 provides a directional indication to the golf player gripping the shaft 300 using the right hand glove 200. When gripping the shaft 300, the right hand glove 200 overlaps the left hand glove 100 over the left thumb 102. More specifically, when the golf player has correctly gripped the shaft 300, the first right indication part 230 would align in the linear direction to point toward the golf player's left shoulder (along his line of sight) from the left side of the shaft 300. When this is achieved, the end of the shaft 300 would be placed near the crease of the left leg of his pants. The second right holding part 240 is placed over the left thumb 102 as the left and right golf gloves 100, 200 are cooperatively used to grip the shaft 300.

Therefore, as shown in FIGS. 2–5, when the left and right golf gloves 100, 200 are cooperatively used to grip the shaft 300, the first left indication part 130 and the first right indication part 230 provide visible directional indication to the golf player, and the golf player can recognize from this directional indication whether he is accurately gripping the shaft 300.

As shown in FIG. 2, the first left indication part 130 and the first right indication part 230 are aligned in a linear manner. When a shaft 300 is gripped, the left thumb 102 is overlapped by the second right holding part 240 of the right hand glove 200. When a shaft 300 is gripped by using the left and right hand gloves 100, 200, the tip or an upper portion of the shaft 300 is placed near the crease of the left pants leg, and the two gripping hands and the shaft 300 together form a Y-shape in front of the golf player. As the golf player is in this gripping stance and holding the shaft using the left and right golf gloves 100, 200, the first left indication part 130 and the first right indication part 230 should be located near the left side of the shaft 300 and should align in a parallel manner pointing toward the left shoulder of the golf player. By checking these indications, the golf player can check for the correctness of his grip.

Further, the second left indication part 140 also helps the golf player to assess the correctness of his grip, as it is designed to appear on the left palm opposite part 101*b*, in addition, the golf player can also check for the correctness of his grip by checking whether the second right holding part 240 correctly overlaps the left thumb 102 of the left hand glove 100.

In addition, the left pressure part 110 and the right pressure part 210 allow the golf player to more tightly and controllably grip the shaft 300 and allow the golf player to more controllably apply the swing force to the shaft 300 to drive a golf ball to a consistent driving distance.

As discussed above, the left pressure part 110, the right pressure part 210, the left holding part 120, the right holding part 220, and the second right holding part 240 cooperate together to allow the golf player to more tightly and controllably grip the shaft 300. The left indication part 130 and the right indication part 230 cooperatively provide directional indication to the golf player and allow the golf player to check for correctness of his grip and also to enable him to modify the grip thereafter. Accordingly, the golf gloves according to an embodiment of the present invention allow all golf players, including the beginners who may be in more need for assistance, to have more accurate grip and control over the golf club.

It will be apparent that the present invention is well adapted to attain the ends and advantages mentioned as well as those inherent therein. While a presently preferred embodiment has been described for purposes of this disclosure, various changes and modifications may be made which are well within the scope of the present invention. Numerous other changes may be made which will readily suggest themselves to those skilled in the art and which are encompassed in the spirit of the invention disclosed and defined in the appended claims.

What is claimed is:

1. A pair of golf gloves with each golf glove having a palm part, a palm opposite part, a thumb, a index finger, a middle finger, a ring finger, and a pinky finger, the golf gloves comprising:

a left hand glove comprising:

a left pressure part formed on a selected portion of at least one of the middle finger, ring finger, and the pinky finger;

a left holding part formed on a selected portion of the palm part;

a first left indication part formed on a selected portion on or near the thumb; and a second left indication part formed on a selected portion of the palm opposite part; and a right hand glove comprising:

a right pressure part formed on a selected portion of at least one of the middle finger and the ring finger;

a right holding part formed on a selected portion of the palm part;

a right indication part formed on a selected portion on or near the thumb; and a second right holding part also formed on a selected portion of the thumb, wherein the left hand glove and the right hand glove provide control over a golf club to a user of the golf gloves and also provide indication to the user of a proper grip of the golf club and enable a subsequent modification of the grip.

2. The golf gloves of claim 1, wherein the first left indication part and the right indication part point toward the left shoulder of the user when the user has gripped the shaft of a golf club using the left and right hand gloves.

3. The golf gloves of claim 1, the second left indication part formed on the selected portion of at least one of the index finger and the middle finger of the left hand glove is visible to the user when the user has gripped the shaft of a golf club using the left and right hand gloves.

4. The golf gloves of claim 1, wherein the left pressure part, the left holding part, the first left indication part, and the second left indication part are made from one or a combination of two or more of:

a first secondary layer placed over the surface of the left hand glove;

a second secondary layer placed under an exposed portion of the left hand glove;

a hole exposing a portion of the left hand glove;

a protruding part protruding on the surface of the left hand glove; and a color on the surface of the left hand glove.

5. The golf gloves of claim 1, wherein the right pressure part, the right holding part, the right indication part, and the second right holding part are made from one or a combination of two or more of:

a first secondary layer placed over the surface of the right hand glove;

a second secondary layer placed under an exposed portion of the right hand glove;

a hole exposing a portion of the right hand glove;

a protruding part protruding on the surface of the right hand glove; and a color on the surface of the right hand glove.

* * * * *